US011439281B2

(12) United States Patent
Azelton et al.

(10) Patent No.: US 11,439,281 B2
(45) Date of Patent: Sep. 13, 2022

(54) DISINFECTING WIPES DISPENSER

(71) Applicant: THE CLOROX COMPANY, Oakland, CA (US)

(72) Inventors: Kerry D. Azelton, Pleasanton, CA (US); Russell E. Bell, Pleasanton, CA (US); Jon Markey, Asheboro, NC (US); Joshua Glessner, High Point, NC (US)

(73) Assignee: The Clorox Company, Oakland, CA (US)

( * ) Notice: Subject to any disclaimer, the term of this patent is extended or adjusted under 35 U.S.C. 154(b) by 45 days.

(21) Appl. No.: 17/017,355

(22) Filed: Sep. 10, 2020

(65) Prior Publication Data

US 2020/0405102 A1 Dec. 31, 2020

Related U.S. Application Data

(63) Continuation of application No. 15/958,164, filed on Apr. 20, 2018, now Pat. No. 10,806,309, which is a (Continued)

(51) Int. Cl.
*A47K 10/42* (2006.01)
*A47K 10/38* (2006.01)

(Continued)

(52) U.S. Cl.
CPC ..... *A47K 10/42* (2013.01); *A47K 10/3818* (2013.01); *A47K 10/421* (2013.01);

(Continued)

(58) Field of Classification Search
CPC .... B65D 83/0894; B65D 43/02; B65D 53/00; B65D 85/62; A47K 10/42; A47K 10/421; A47K 2010/3266

(Continued)

(56) References Cited

U.S. PATENT DOCUMENTS 3,092,439 A 6/1963 Harrison
3,749,296 A 7/1973 Harrison (Continued)

FOREIGN PATENT DOCUMENTS

CN 203889189 10/2014
EP 0179498 B1 7/1989

(Continued)

OTHER PUBLICATIONS

PCT Search Report dated Jul. 16, 2015, International Application No. PCT/US15/25757.

(Continued)

*Primary Examiner* — Rakesh Kumar
(74) *Attorney, Agent, or Firm* — Workman Nydegger

(57) ABSTRACT

The present invention is for wipe dispensers for dispensing interconnected wipes. An exemplary wipes dispenser may include a container body and a removable lid forming an interior region into which a plurality of interconnected wipes may be disposed. Pulling on a lead end of a lead wipe causes a following wipe to also be pulled and follow the lead wipe. The removable lid may cover a portion of a container aperture (e.g., an open top of the container body). A landing member in the lid covers a portion of the container aperture by extending from a top rim of the container body toward the middle of the interior region. The landing member may form an angle with a substantially vertical exterior wall of the container, where the formed angle may be less than 90°. In an embodiment, the landing member may include a concavely shaped portion. The landing member may include one or more fingers.

21 Claims, 14 Drawing Sheets

Related U.S. Application Data continuation of application No. 14/684,842, filed on Apr. 13, 2015, now Pat. No. 9,974,419.

(60) Provisional application No. 61/983,408, filed on Apr. 23, 2014.

(51) Int. Cl.

| | |
|---|---|
| ***B65D 43/02*** | (2006.01) |
| ***B65D 53/00*** | (2006.01) |
| ***B65D 85/62*** | (2006.01) |
| ***A47K 10/32*** | (2006.01) |

(52) U.S. Cl.

CPC ..... *B65D 43/02* (2013.01); *B65D 53/00* (2013.01); *B65D 85/62* (2013.01); *A47K 2010/3266* (2013.01)

(58) Field of Classification Search

USPC ..... 221/38, 63

See application file for complete search history.

(56) References Cited

U.S. PATENT DOCUMENTS

| | | | | |
|---|---|---|---|---|
| 3,868,052 | A | 2/1975 | Rockefeller | |
| 4,262,816 | A | 4/1981 | Margulies | |
| 4,289,262 | A | 9/1981 | Finkelstein | |
| D263,932 | S | 4/1982 | Daenen et al. | |
| 4,387,819 | A | 6/1983 | Corsette | |
| 4,462,507 | A | 7/1984 | Margulies | |
| 4,496,066 | A | 1/1985 | Bullock, III | |
| 4,526,291 | A | 7/1985 | Margulies | |
| 4,682,700 | A | 7/1987 | Montgomery et al. | |
| 4,815,620 | A | 3/1989 | Bullock, III | |
| D354,224 | S | 1/1995 | Norton et al. | |
| D354,225 | S | 1/1995 | Norton et al. | |
| 5,516,001 | A | 5/1996 | Muckenfuhs et al. | |
| 5,699,912 | A | 12/1997 | Ishikawa et al. | |
| 5,718,353 | A | 2/1998 | Kanfer et al. | |
| 5,730,309 | A | 3/1998 | Jiradejnunt et al. | |
| 6,082,567 | A | 7/2000 | Bietzer et al. | |
| 6,158,614 | A | 12/2000 | Haines et al. | |
| 6,182,858 | B1 | 2/2001 | Hartog | |
| D443,450 | S | 6/2001 | Ruhotas et al. | |
| 6,279,775 | B1 | 8/2001 | Parkes et al. | |
| D449,528 | S | 10/2001 | Buck et al. | |
| 6,364,101 | B1 | 4/2002 | Schultz | |
| 6,394,298 | B1 * | 5/2002 | Zaidman | B65D 47/0871 220/827 |
| 6,409,044 | B1 | 6/2002 | Brown et al. | |
| D466,807 | S | 12/2002 | Buck et al. | |
| 6,536,616 | B2 | 3/2003 | Sandor et al. | |
| 6,554,156 | B1 | 4/2003 | Chong | |
| 6,581,792 | B1 | 6/2003 | Limanjaya | |
| 7,090,068 | B2 | 8/2006 | Matsuo | |
| 7,090,088 | B2 | 8/2006 | von Holdt, Jr. | |
| D531,499 | S | 11/2006 | Zaldman | |
| D531,897 | S | 11/2006 | Evans et al. | |
| 7,143,906 | B2 | 12/2006 | Chasid | |
| D541,173 | S | 4/2007 | Karussi et al. | |
| 7,213,720 | B2 | 5/2007 | Giraud | |
| 7,216,760 | B2 | 5/2007 | Forrest, Jr. | |
| 7,216,775 | B2 | 5/2007 | Evans et al. | |
| D544,346 | S | 6/2007 | Karussi et al. | |
| 7,546,930 | B2 | 6/2009 | Banik et al. | |
| 7,556,175 | B2 | 7/2009 | Simkins | |
| 7,703,621 | B2 | 4/2010 | Evans et al. | |
| 7,731,057 | B2 | 6/2010 | Evans et al. | |
| 7,806,292 | B2 | 10/2010 | Simkins | |
| 7,922,036 | B2 | 4/2011 | Bendor et al. | |
| 7,988,008 | B2 | 8/2011 | Banik et al. | |
| 8,104,657 | B2 | 1/2012 | Barella | |
| 8,297,461 | B2 | 10/2012 | Evans | |
| D671,426 | S | 11/2012 | Pickens et al. | |
| 8,308,008 | B2 | 11/2012 | Perry et al. | |
| D672,647 | S | 12/2012 | Hora et al. | |
| D703,534 | S | 4/2014 | Kikuo | |
| D703,535 | S | 4/2014 | Kikuo | |
| 8,944,279 | B2 | 2/2015 | Shoaf et al. | |
| 9,498,091 | B2 | 11/2016 | Kikuo | |
| 2003/0080018 | A1 | 5/2003 | Nally | |
| 2004/0011813 | A1 | 1/2004 | Kasting et al. | |
| 2004/0099681 | A1 | 5/2004 | Julius | |
| 2005/0067313 | A1 | 3/2005 | Banik et al. | |
| 2005/0087543 | A1 | 4/2005 | Smith | |
| 2005/0205594 | A1 | 9/2005 | Evans et al. | |
| 2006/0186132 | A1 | 8/2006 | Panning et al. | |
| 2006/0191933 | A1 * | 8/2006 | Hicks | B65D 47/0804 220/259.2 |
| 2007/0215632 | A1 | 9/2007 | Bendor et al. | |
| 2008/0035663 | A1 | 2/2008 | Byl et al. | |
| 2008/0110920 | A1 | 5/2008 | Hlista et al. | |
| 2009/0114669 | A1 | 5/2009 | Decker et al. | |
| 2009/0152290 | A1 | 6/2009 | Wang et al. | |
| 2009/0194554 | A1 | 8/2009 | Bliss et al. | |
| 2009/0194555 | A1 | 8/2009 | Hoefing et al. | |
| 2009/0200328 | A1 | 8/2009 | Hoefing et al. | |
| 2009/0289077 | A1 | 11/2009 | Melin et al. | |
| 2009/0314793 | A1 * | 12/2009 | Reedy | B60R 7/084 221/45 |
| 2010/0078443 | A1 * | 4/2010 | Hoefing | A47K 10/3818 221/45 |
| 2010/0108706 | A1 | 5/2010 | Oman | |
| 2010/0133287 | A1 | 6/2010 | Tramontina et al. | |
| 2010/0206896 | A1 | 8/2010 | Ray et al. | |
| 2010/0270326 | A1 | 10/2010 | Wong et al. | |
| 2011/0139807 | A1 | 6/2011 | Ray et al. | |
| 2012/0017766 | A1 | 1/2012 | Anson et al. | |
| 2012/0118905 | A1 | 5/2012 | Lindbergh | |
| 2012/0145737 | A1 | 6/2012 | Ray et al. | |
| 2013/0008919 | A1 | 1/2013 | Honan et al. | |
| 2013/0153597 | A1 | 6/2013 | Hill et al. | |
| 2013/0240556 | A1 | 9/2013 | Kikuo | |
| 2014/0021219 | A1 | 1/2014 | Honan | |
| 2014/0158687 | A1 | 6/2014 | Honan et al. | |
| 2014/0190983 | A1 * | 7/2014 | Sanguinet | A47K 10/3818 221/63 |
| 2014/0291343 | A1 * | 10/2014 | Neitzel | A47K 10/3818 221/63 |
| 2014/0367400 | A1 | 12/2014 | Crudge et al. | |
| 2015/0069081 | A1 | 3/2015 | Fujimoto | |
| 2015/0164290 | A1 | 6/2015 | Leung et al. | |
| 2015/0305579 | A1 * | 10/2015 | Azelton | B65D 85/62 221/63 |
| 2018/0235413 | A1 | 8/2018 | Azelton et al. | |

FOREIGN PATENT DOCUMENTS

| | | | | |
|---|---|---|---|---|
| EP | 1851127 | B1 | 7/2007 | |
| GB | 2335624 | | 9/1999 | |
| GB | 2447415 | A * | 9/2008 | A47K 10/3818 |
| WO | WO-9819946 | A1 * | 5/1998 | B65D 83/0805 |
| WO | WO9819946 | A1 | 5/1998 | |
| WO | WO2006093579 | A1 | 9/2006 | |
| WO | WO2007105182 | A1 | 9/2007 | |
| WO | WO-2008110770 | A1 * | 9/2008 | A47K 10/3818 |
| WO | WO2008110770 | A1 | 9/2008 | |
| WO | WO-2013076467 | A2 * | 5/2013 | A47K 10/38 |
| WO | WO2013076467 | A2 | 5/2013 | |
| WO | WO-2013189511 | A1 * | 12/2013 | B65D 83/0805 |
| WO | WO2013189511 | A1 | 12/2013 | |

OTHER PUBLICATIONS

Final Office Action dated Dec. 12, 2017, U.S. Appl. No. 15/336,548, filed Oct. 27, 2016.

Final Office Action dated Jan. 12, 2017, U.S. Appl. No. 14/684,842, filed Apr. 13, 2015.

Non Final Office Action dated Aug. 24, 2017, U.S. Appl. No. 15/336,548, filed Oct. 27, 2016.

Non Final Office Action dated Jul. 14, 2016, U.S. Appl. No. 14/684,842, filed Apr. 13, 2015.

(56) References Cited

OTHER PUBLICATIONS

Notice of Allowance received for U.S. Appl. No. 15/958,164, dated Jul. 10, 2020, 10 pages.
U.S. Notice of Allowance dated Apr. 6, 2018, U.S. Appl. No. 15/336,548, filed Oct. 27, 2016.

* cited by examiner

DISINFECTING WIPES DISPENSER

CROSS REFERENCE TO RELATED APPLICATIONS

This application is a continuation of U.S. patent application Ser. No. 15/958,164, filed on Apr. 20, 2018, which is a continuation of U.S. patent application Ser. No. 14/684,842, filed on Apr. 13, 2015, which has granted as U.S. Pat. No. 9,974,419, issued on May 22, 2018, entitled DISINFECTING WIPES DISPENSER, which claims the benefit of Provisional Application No. 61/983,408, filed Apr. 23, 2014 entitled DISINFECTING WIPES DISPENSER. The disclosure(s) of which are incorporated herein in their entirety.

BACKGROUND OF THE INVENTION

1. The Field of the Invention

The present invention relates to containers including a removable lid, such as those used in the dispensing of wipes used in disinfection, cleaning, etc.

2. Description of Related Art

Wetted wipes including a cleaning formulation impregnated therein are employed in a wide variety of circumstances for disinfecting or cleaning various surfaces. Because the wipes are pre-wetted with a cleaning formulation, it is important that the container be sealed so as to prevent the wipes from prematurely drying out.

Such wipes may initially be attached to one another, with a line of perforations, rouletting, or similar mechanism by which they may in theory be easily separated from one another, as a lead wipe may be torn from the following wipe as it is pulled from the container. In actual practice, with existing dispensing configurations, there is a tendency for the lead wipe to not fully separate from the following wipe as the lead wipe is pulled from the dispenser (referred to as "roping"), leading to more than the single desired wipe being dispensed. Such roping leads to waste, as more wipes than the user intended end up being dispensed from the container.

Another issue with existing configurations is the tendency for the lead wipe to fall back into the container, requiring the user to retrieve the lead wipe and rethread it into the retention mechanism. As a result, there continues to be a need for improved wipe dispenser configurations that may alleviate one or more of these issues.

BRIEF SUMMARY OF THE INVENTION

In an embodiment, the present invention is directed to a wipes dispenser comprising a container including a container body and a removable lid forming an interior region containing a plurality of wipes that are interconnected such that pulling on a lead wipe of the plurality of wipes causes a following wipe of said plurality of wipes to also be pulled and follow the lead wipe. The wipes dispenser also includes a container aperture defined through an exterior wall of the container (e.g., over which the removable lid may be disposed). The removable lid may further include a rigid landing member that covers a portion of the container aperture by extending from a top rim of the container body toward the middle of the interior region of the container. The landing member may form an angle with a substantially vertical exterior wall of the container that is less than 90°.

For example, the landing member may be angled downward, towards the bottom of the interior region of the container, or the landing member may include a concave, downwardly curved surface, which similarly forms an angle with the substantially vertical exterior wall of the container that is less than 90°. The landing member may further include a gripping channel therein that communicates with the interior of the container through the container aperture, wherein the plurality of wipes are removed from the container by being pulled through the gripping channel, the gripping channel separating a lead wipe from a following wipe as the lead wipe is pulled through the gripping channel. The landing member may further include a secondary aperture which allows a user to reach into the container, grab a lead wipe, and thread the lead wipe through the gripping channel.

Such configurations aid in reducing the tendency of the wipes to "rope", particularly where the wipes are pulled from the container in a substantially vertical direction, which consumers are prone to do. Such configurations allow a user to quickly pull the lead wipe through the gripping channel, separating it from the following wipe as it is pulled through the gripping channel. The inclusion of the secondary aperture advantageously allows the user to reach through the secondary aperture of the removable lid and grab a lead wipe if the lead wipe is not already threaded within the gripping channel, without the user's fingers being uncomfortably scraped by surfaces adjacent the secondary aperture.

Another embodiment of the present invention is directed to a wipes dispenser including a container having a container body and a removable lid forming an interior region containing a plurality of wipes that are interconnected such that pulling on a lead end of a lead wipe of the plurality of wipes causes a following wipe of the plurality of wipes to also be pulled and follow the lead wipe. The wipes dispenser further includes a container aperture defined through an exterior wall of the container. The removable lid may include a rigid landing member that covers a portion of the container aperture by extending from a top rim of the container body toward the middle of the interior region of the container creating a concave portion of the landing member. The landing member may further include one or more fingers, and a gripping channel communicating with the interior of the container through the container aperture wherein the plurality of wipes are removed from the container by being pulled through the gripping channel, the gripping channel separating a lead wipe from a following wipe as the lead wipe is pulled through the gripping channel. The landing member further includes a secondary aperture therethrough which allows a user to reach into the container and grab and thread a lead wipe through the gripping channel.

Another embodiment is directed to a wipes dispenser comprising a container including a container body and a removable lid. The container body and removable lid form an interior region containing a plurality of wipes that are interconnected such that pulling on a lead end of a lead wipe of the plurality of wipes causes a following wipe of the plurality of wipes to also be pulled and follow the lead wipe. A container aperture is defined through an exterior wall of the container which may be partially covered by the removable lid. The removable lid includes a crab claw sealing member which bends as it contacts a side rim of the container body when the lid is secured to the container body. The lid further includes a rigid landing member which covers a portion of the container aperture by extending from a top rim of the container body towards the middle of the interior region of the container. The landing member comprises one or more fingers. A gripping channel in the landing member communicates with the interior of the container through the container aperture, and the plurality of wipes are removed from the container by being pulled through the gripping channel, the gripping channel separating a lead wipe from a following wipe as the lead wipe is pulled through the gripping channel. The landing member may further include a secondary aperture which allows a user to reach into the container and grab a lead wipe and thread it through the gripping channel.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
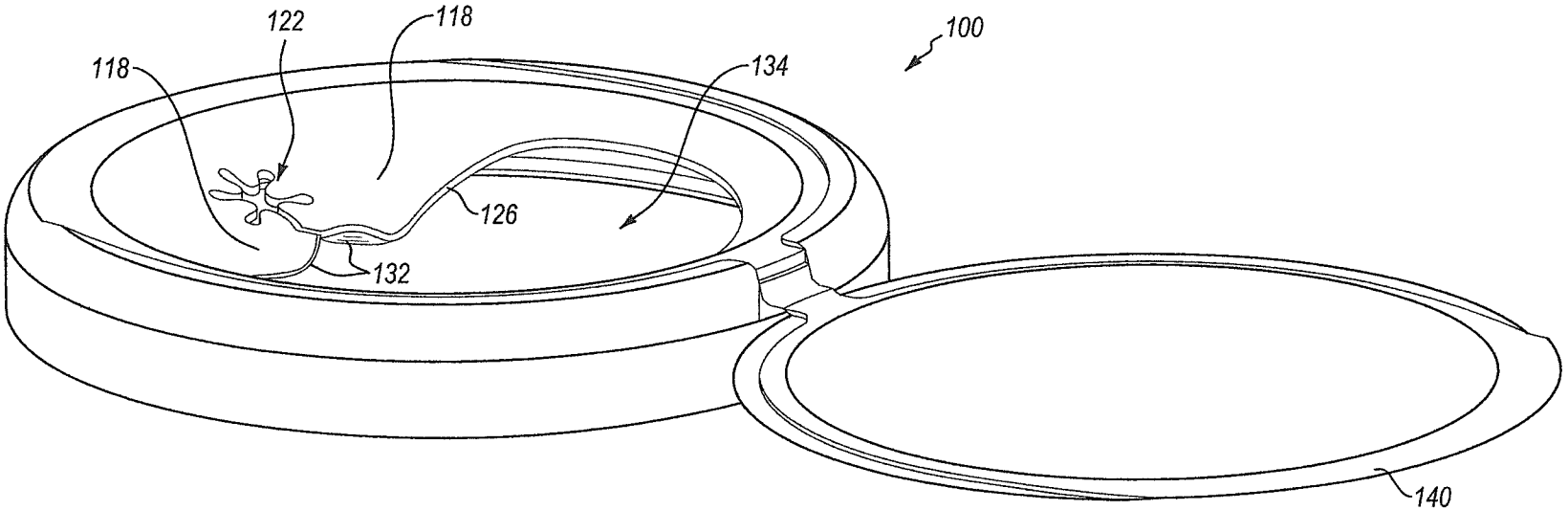
FIG. 1 is a perspective view of an exemplary removable lid including a hinged lid cover that may be used with wipes dispensers according to the present invention.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

The present invention is directed to wipes dispensers from which wipes may be dispensed one at a time, as a lead wipe of a plurality of interconnected wipes is pulled from the dispenser, becoming separated from the following wipe as it is dispensed. An exemplary wipes container may include a container body and a removable lid coupleable to the container body. The container body and lid form an interior region into which a plurality of interconnected wipes (e.g., arranged as a "donut") may be disposed, such that pulling on a lead end of a lead wipe causes a following wipe of the plurality of interconnected wipes to also be pulled and follow the lead wipe. The wipes dispenser includes a container aperture (e.g., an open top of a cylindrical container body) defined through an exterior wall of the container. The removable lid may cover a portion of the container aperture. The removable lid may include a rigid landing member that covers a portion of the container aperture by extending from a top rim of the container body toward the middle of the interior region of the container. The landing member may form an angle with a substantially vertical exterior wall of the container, where the formed angle may be less than 90°. In an embodiment, the landing member may include a concavely shaped portion. The landing member may include one or more fingers.

The landing member may include a gripping channel communicating with the interior of the container through the container aperture, wherein the plurality of wipes are removed from the container by being pulled through the gripping channel, the gripping channel separating a lead wipe from a following wipe as the lead wipe is pulled through the gripping channel. A secondary aperture may be provided in the landing member which allows a user to reach into the container and grab a lead wipe and thread the lead wipe through the gripping channel. A crab claw sealing member may be provided on an internal surface of the removable lid, which crab claw sealing member bends as it contacts a side rim of the container body when the removable lid is secured to the container body.

III. Exemplary Wipes Dispensers

Figure 2A:
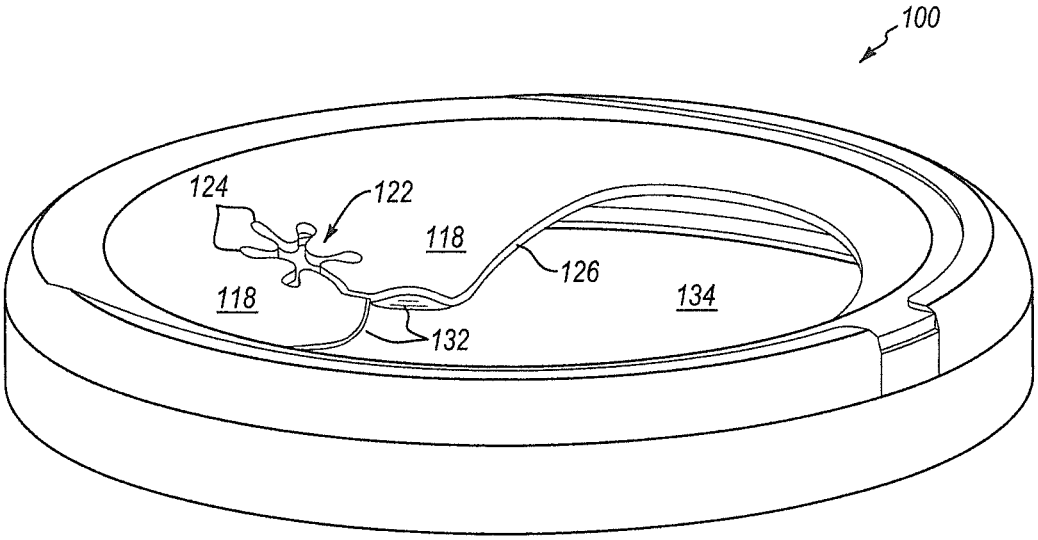
FIG. 2A is a perspective view of the removable lid of FIG. 1, without showing the hinged lid cover for simplicity.
Figure 2B:
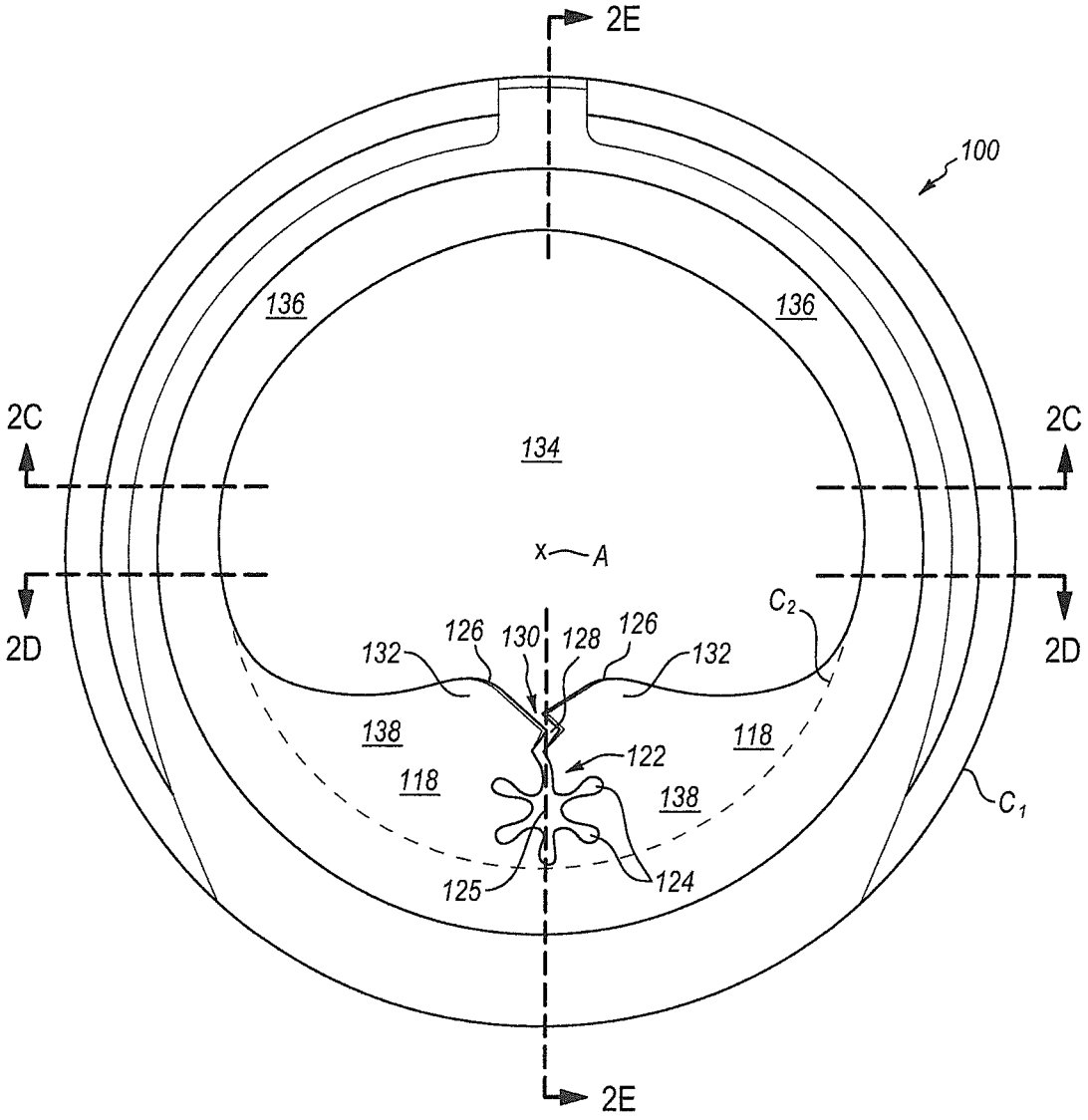
FIG. 2B is a top plan view of the removable lid of FIG. 2A.
Figure 2C:
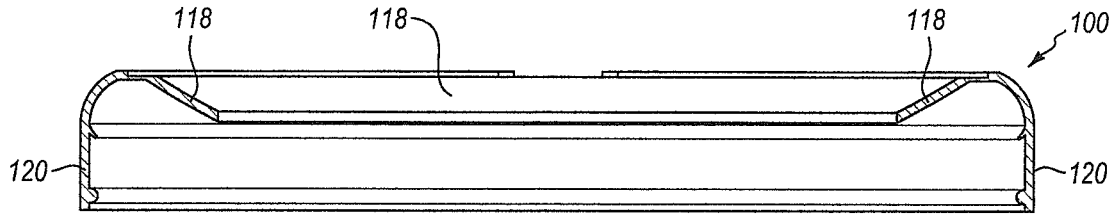
FIG. 2C is a cross-sectional view taken along lines 2C-2C of FIG. 2B.
Figure 2D:
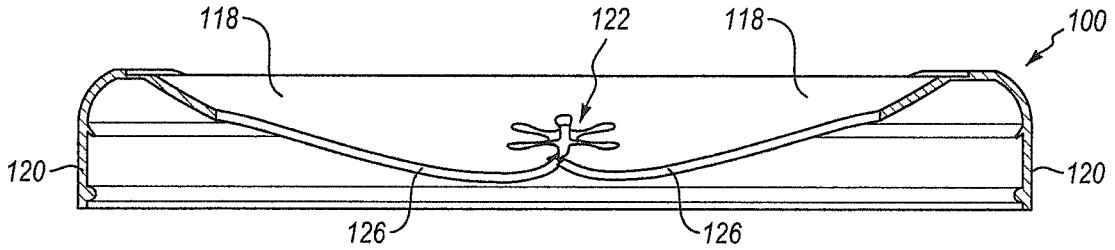
FIG. 2D is a cross-sectional view taken along lines 2D-2D of FIG. 2B.
Figure 2E:
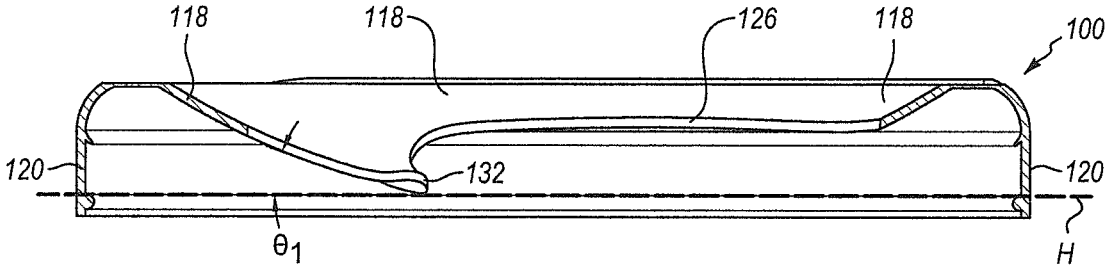
FIG. 2E is a cross-sectional view taken along lines 2E-2E of FIG. 2B.
Figure 3:
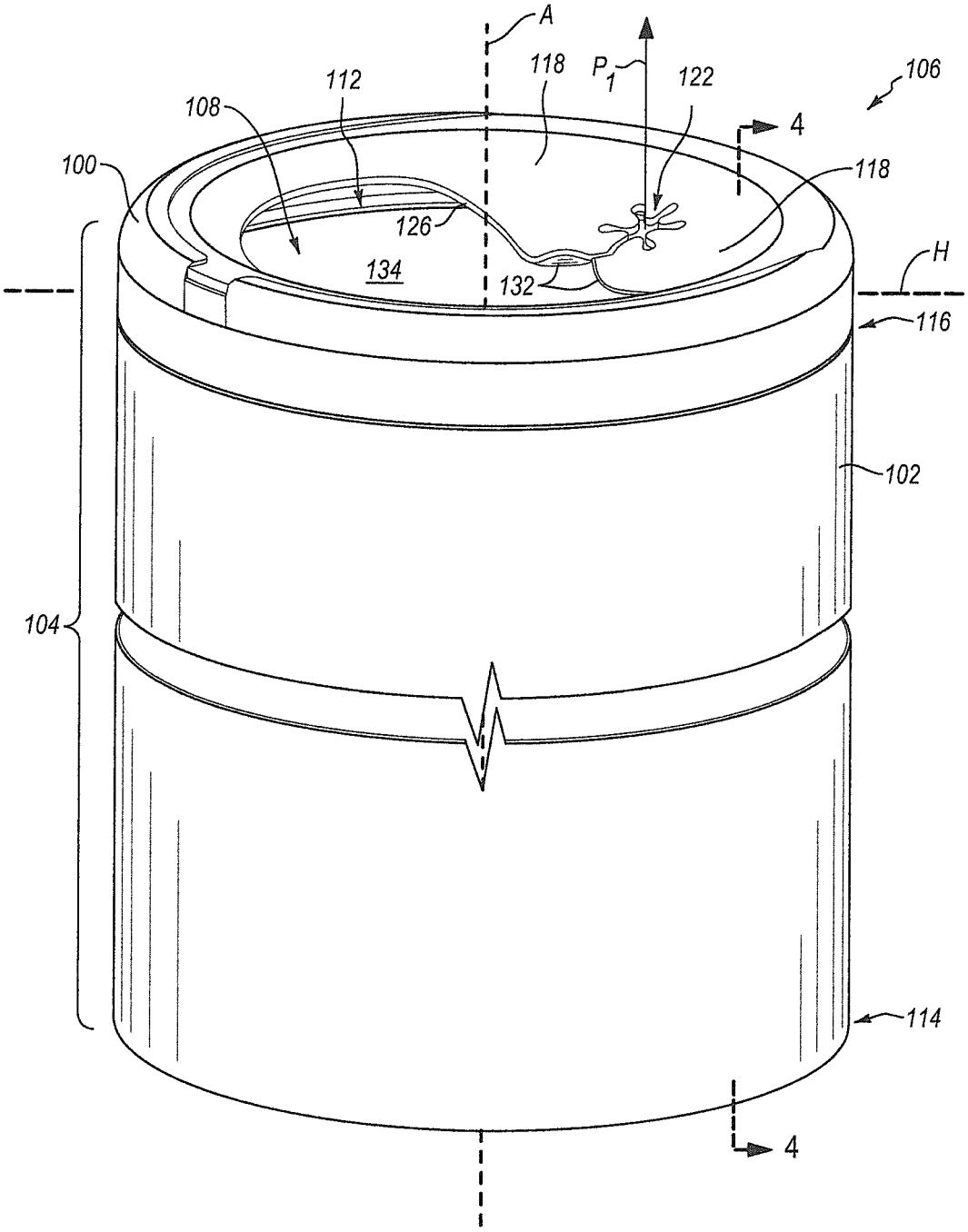
FIG. 3 is a perspective view of an exemplary wipes dispenser including the removable lid of FIG. 2A coupled over an exemplary container body.
Figure 5:
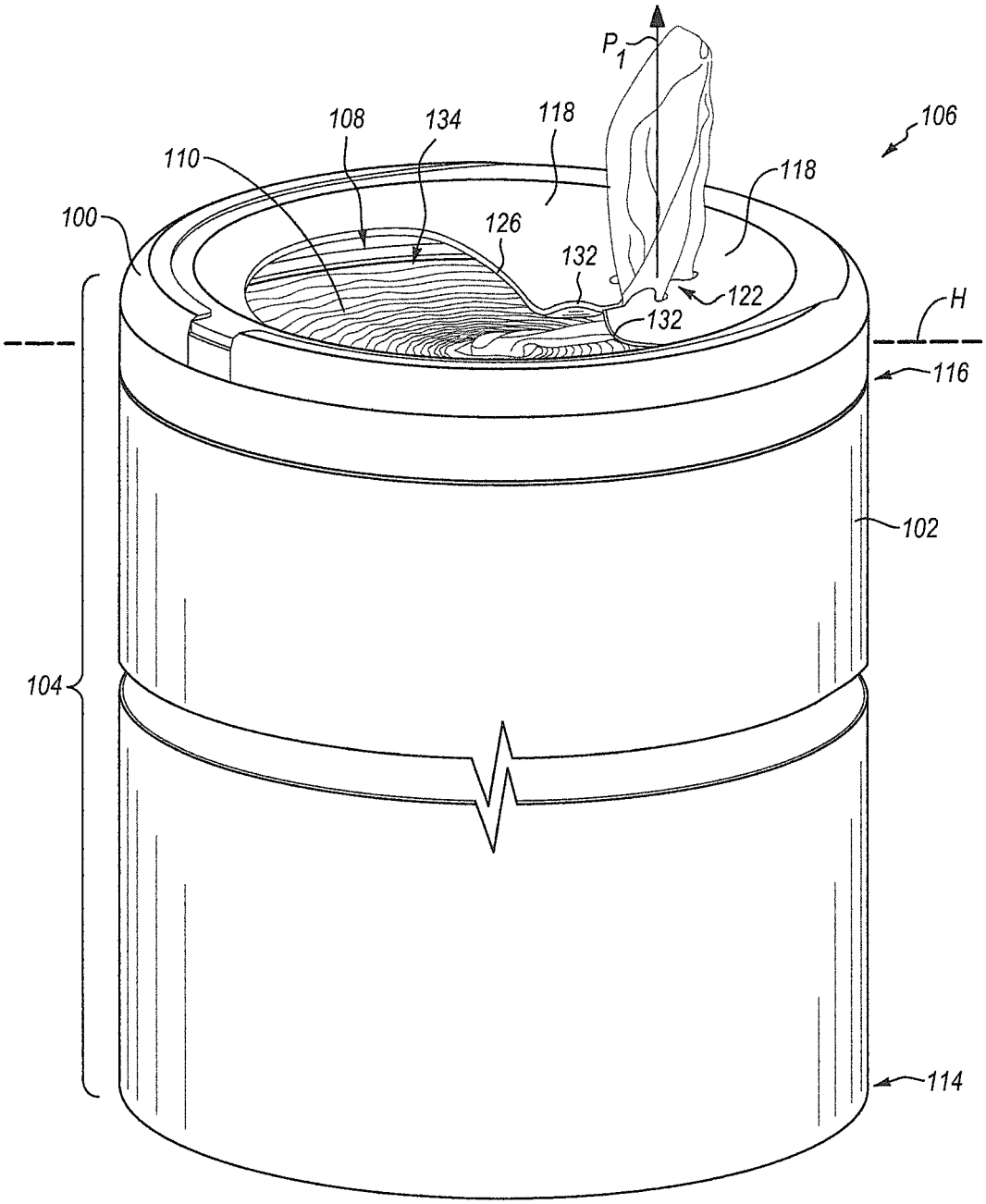
FIG. 5 is a perspective view of an exemplary wipes dispenser similar to that of FIG. 3, but shown with a wipe threaded in the gripping channel ready to be dispensed.
Figure 5A:
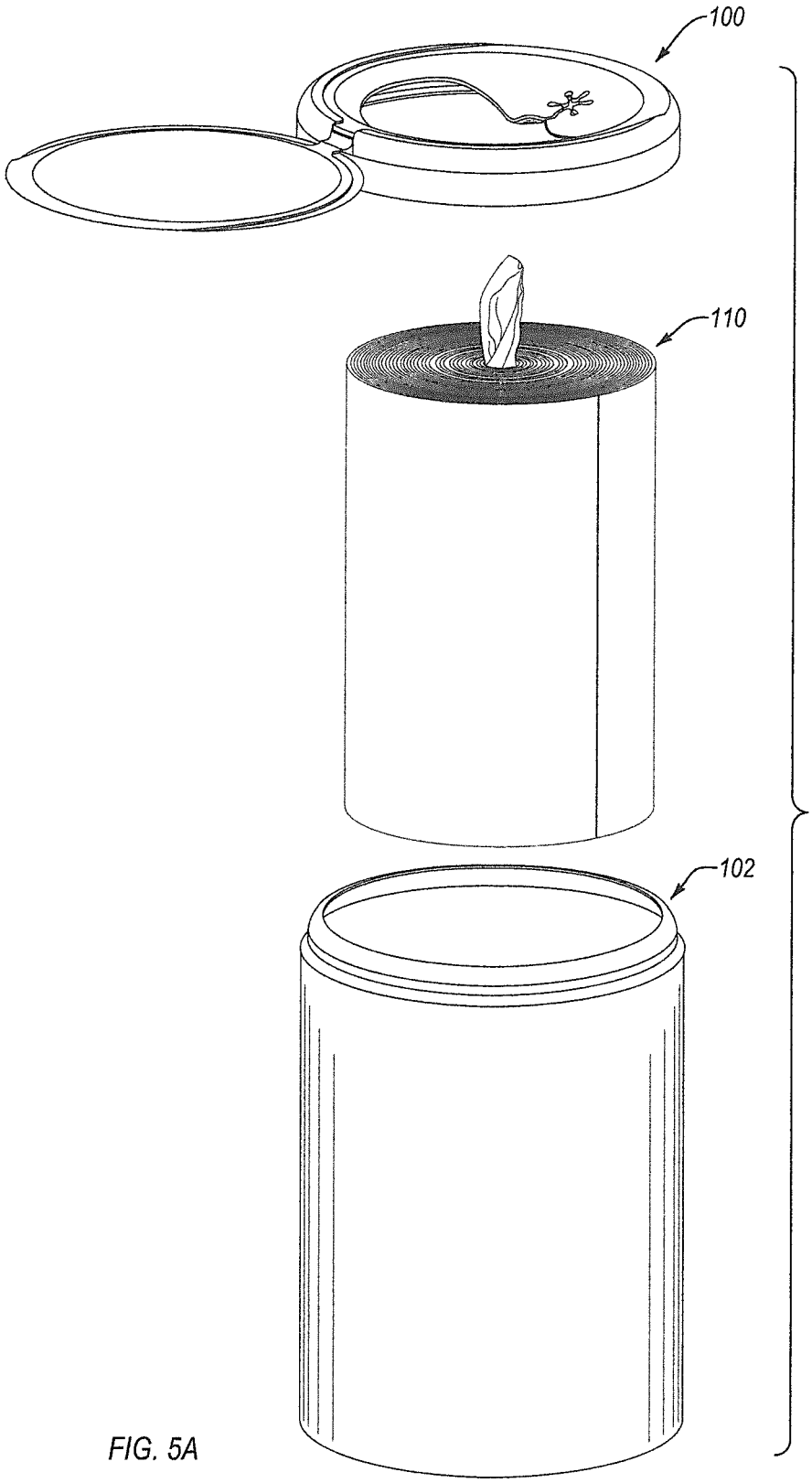
FIG. 5A is an exploded view of the exemplary wipes dispenser of FIG. 5.
Figure 6A:
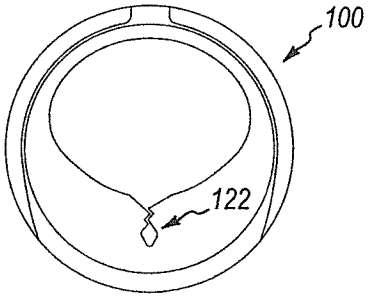
FIGS. 6A-6M are top plan views showing removable lids similar to that of FIG. 2B, but each with an alternatively configured gripping channel.
Figure 6B:
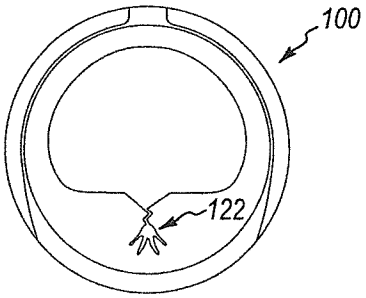
Figure 6C:
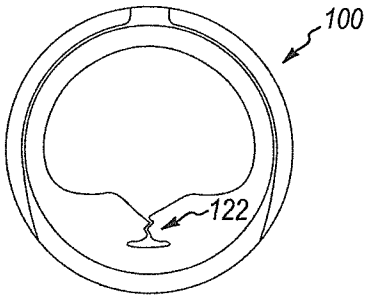
Figure 6D:
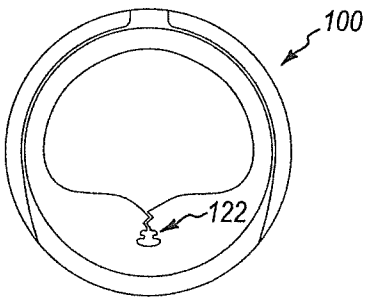
Figure 6E:
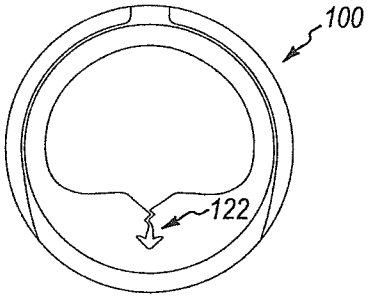
Figure 6F:
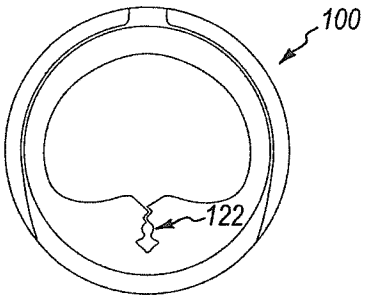
Figure 6G:
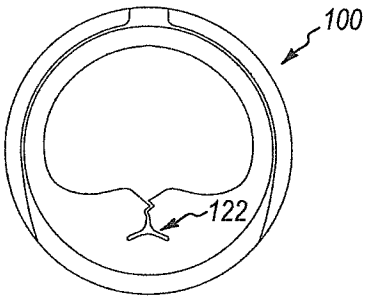
Figure 6H:
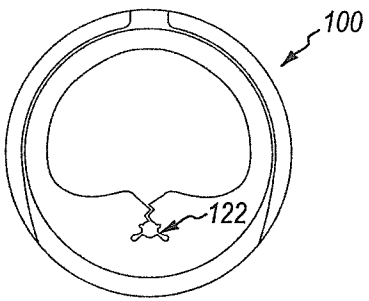
Figure 6I:
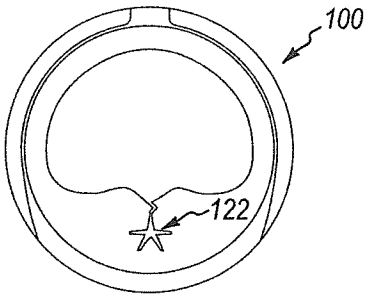
Figure 6J:
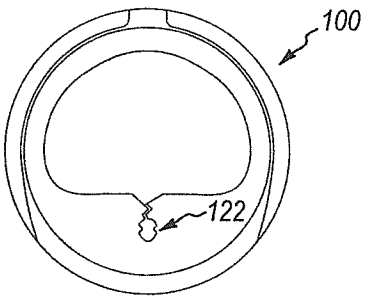
Figure 6K:
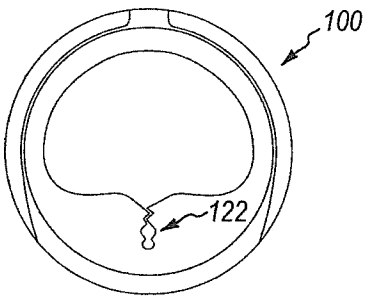
Figure 6M:
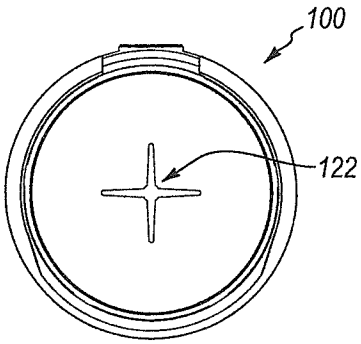
Figure 6L:
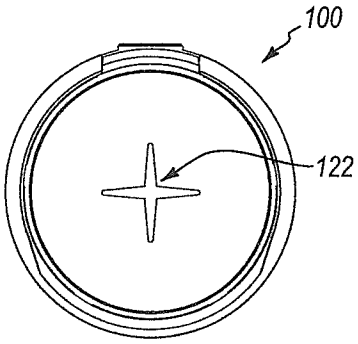

FIGS. 1-3 illustrate an exemplary removable lid 100 for use with a container body 102 so as to form a container 104 that may form a portion of a wipes dispenser 106 according to the present invention. FIGS. 1-2E illustrate various views of removable lid 100. As shown in FIG. 1, removable lid 100 may include a hinged cover 140, which closes over landing member 118 and secondary aperture 134. Hinged cover 140 is not shown in the remaining Figures for the sake of simplicity. FIG. 3 shows a perspective view of exemplary wipes dispenser 106, including container 104 that is formed by removable lid 100 and container body 102. Container body 102 and removable lid 100 of wipes dispenser 150 form an interior region 108, e.g., within hollow container body 102, capped by removable lid 100 (see FIG. 3). As shown in FIG. 5, within interior region 108 may be disposed a plurality of wipes 110 that are interconnected such that pulling on a lead end of a lead wipe of the plurality of wipes causes a following wipe of the plurality of wipes to also be pulled and follow the lead wipe. Wipes 110 may be wound in the shape of a donut, as seen in FIG. 5. FIG. 5A shows a donut of wipes 110 exploded from the container body 102 and removable lid 100.

A container aperture 112 may be defined through an exterior wall of container 104. For example, container body 102 may be generally cylindrical in shape, with a hollow interior region 108. The bottom 114 of container body 102 may be closed, while the top 116 of container body 102 may be open, so as to define container aperture 112. A portion of container aperture 112 may be covered by removable lid 100.

Removable lid 100 may include a landing member 118 that may be formed from a rigid material. Rigid landing member 118 is part of lid 100, and covers a portion of container aperture 112 by extending from top rim 116 of container body 102 inwardly toward a middle (e.g., defined by a longitudinal axis A) of interior region 108 of container 104. Landing member 118 may include one or more features configured to enhance the ability of a user to pull wipes from container in a substantially vertical direction, while limiting any tendency of the interconnected wipes to "rope", to disengage from gripping channel 122 and fall back into container 104, or both. For example, as perhaps best seen in FIGS. 2D-2E, landing member 118 may form an angle with the substantially vertical exterior wall (e.g., wall 120) of container 108 that is less than 90°. In other words, landing member 118 may not be horizontal. For example, as illustrated in FIG. 2E, in an embodiment, an angle between landing member 118 and substantially vertical wall 120 may be from about 45° to 85°, from about 45° to 80°, or from about 65° to about 75° (e.g., about 70°). Furthermore, as illustrated in FIGS. 1-3, landing member 118 may include a concave portion. For example, landing member 118 may be concavely curved, rather than generally planar, curving downward as landing member 118 extends from top rim 116 (FIG. 3) towards longitudinal axis A.

Such an angled or downwardly curved configuration advantageously decreases any tendency of the interconnected wipes to "rope" as they are pulled from wipes dispenser 106, through a gripping channel 122 in landing member 118, particularly where the wipes are pulled in a generally vertical orientation, as users are prone to do. For example, existing wipes containers often instruct the user to pull wipes at an angle (e.g., 45°) relative to vertical through a generally planar, horizontal landing member in an attempt to reduce roping. Users are prone to ignore such instructions, preferring instead to pull wipes out of such dispensers in a substantially vertical orientation. By providing a landing member 118 that is downwardly angled or concavely curved, a non-perpendicular angled relationship is advantageously provided between landing member 118 and the substantially vertical wipe as it is pulled, which angle aids in detaching the lead wipe from the following wipe as it is dispensed, reducing any roping tendency. Such an angle or concavely curved portion ensures increased frictional contact against the edges of gripping channel 122 as the wipe is pulled, aiding in separation of the lead wipe from a following wipe. Such a configuration may also aid in preventing fall back of the lead wipe through gripping channel 122 of landing member 118.

Container aperture 112 (FIG. 3) may reside in a substantially horizontal base plane. The angle between the horizontal base plane H of container aperture 112 and the direction at which the wipes are pulled from the container (i.e., a pull plane $P_1$) may be from about 70° and about 120°. For example, even if instructed otherwise, many consumers prefer to pull wipes at an angle of about 90° relative to the horizontal base plane, as seen in FIGS. 3 and 5. As described above, providing an angle between the direction of wipe pull (e.g., substantially vertical, perpendicular to container aperture 112) and the landing member, so that the given angle is not perpendicular (e.g., less than 90°) aids in preventing roping of the wipes as they are pulled from the dispenser. For example, the angle formed between the horizontal base plane and landing member 118 (e.g., at a point of entry through central aperture 125 (FIG. 2B) of gripping channel 122) may be from 5° to about 45°, from about 10° to about 45°, or from about 15° to about 25° as perhaps best seen in FIG. 2E.

Gripping channel 122 is perhaps best seen in FIG. 2B. Gripping channel 122 in landing member 118 communicates with interior 108 of container 104 through container aperture 112 such that individual wipes of the plurality of wipes are removed from container 104 by being pulled through gripping channel 122. Gripping channel 122 is configured to separate a lead wipe from a following wipe as the lead wipe is pulled through gripping channel 122. As illustrated in FIGS. 1-3, gripping channel 122 may be star or flower shaped, including a plurality of arms or petals 124. For example, the illustrated embodiment includes 6 petals surrounding a central aperture 125 through which a lead wipe may be pulled. As illustrated, the arms or petals 124 may include a narrower, constricted portion between the central aperture 125 of the gripping channel and the end of the respective arm or petal 124. Such a plurality of arms or petals 124 may further serve to separate the lead wipe from a following wipe, particularly where the wipe may be "pinched" by a constricted portion of each arm or petal 124.

Gripping channel 122 may be in communication with an outer edge 126 of landing member 118, including a threading portion 128 between outer edge 126 and the central aperture 125 of channel 122, which allows a user to thread a lead wipe into the central aperture 125 through threading portion 128. As shown, the entrance 130 into threading portion 128 at outer edge 126 may be funnel shaped, including a wider dimension at entrance 130, which narrows towards threading portion 128. In addition, as shown, threading portion 128 may be zig-zag shaped or include a curve, which may aid in preventing back-out of a lead wipe that is already engaged within central aperture 125 of gripping channel 122.

Where threading portion 128 is provided in landing member 118, a plurality of fingers 132 may be defined (e.g., on either side of entrance 130 and threading portion 128). Such fingers may extend towards the middle of interior region 108 and longitudinal axis A. For example, fingers 132 may define the furthest extension of landing member 118 towards longitudinal axis A. To further aid in easy threading of a lead wipe through entrance 130, into threading portion 128, and eventually into central channel 125 of gripping channel 122, fingers 132 may be oppositely curved or angled relative to adjacent portions of landing member 118, forming an upwardly directed re-curved or re-angled portion. Such a feature is perhaps best seen in FIGS. 1, 2A, and 2E.

To further aid in preventing roping of a following wipe as a lead wipe is dispensed, gripping channel 122 may be off-set from a center point (e.g., axis A) of container 104. Similarly, gripping channel 122 may be off-set from a center point of container aperture 112. In the embodiment illustrated in FIGS. 1-3, the center point of aperture 112 and container 104 may be the same, represented by longitudinal axis A, although it will be appreciated that other configurations are possible. For example, container 104 is illustrated as cylindrical, although this is not required, as various rectangular box-like configurations are certainly also possible. Off-setting of the gripping channel advantageously allows the wipes to enter gripping channel 122 from below at an angle (i.e., as opposed to entering vertically, with the center of the donut aligned with gripping channel 122), which further serves to ensure that the lead wipe separates from the following wipe as the lead wipe is pulled through gripping channel 122. This angled entry into gripping channel 122 is perhaps best seen in FIG. 5.

This causes the path of the wipe as it is dispensed from donut 110 into gripping channel 122 to be other than a simple vertical path, so that the wipe is pulled into gripping channel 122 at an angle as a result of the off-set. This other than simple vertical path creates increased engagement between the lead wipe and the edges of gripping channel 122, facilitating separation of the lead wipe from the following wipe. Once the lead end of the lead wipe passes through gripping channel 122 the lead end of the lead wipe is pulled vertically, also resulting in engagement between the edges of gripping channel 122 and the lead wipe, because of the concave or downwardly angled orientation of landing member 118 in the region of gripping channel 122. Such engagement ensures efficient separation of the lead wipe from a following wipe as the wipes are dispensed.

Removable lid 100 further includes a secondary aperture 134 through landing member 118, which allows a user to easily reach into container 104 and grab a lead wipe, and thread it through gripping channel 122. Secondary aperture may advantageously be relatively large relative to the size of landing member 118, occupying a significant fraction of container aperture 112. For example, as seen in FIG. 2B, container aperture 112 may have a diameter that is approximately equal to the diameter of removable lid 100, corresponding to circle $C_1$. Secondary aperture 134 defined through landing member 118 may include a portion opposite gripping channel 122 bounded by a radius associated with a circle $C_2$. Circle $C_2$ may have a size that is about 50% to about 95%, 60% to about 85%, or about 70% to about 80% that of circle $C_1$. For example, circle $C_2$ may have a radius that is about 75% that of $C_1$. Such a relatively large circle $C_2$ allows for a secondary aperture 134 that is relatively large, allowing a user to easily insert their fingers or hand to retrieve a lead wipe for threading into gripping channel 122. As shown, landing member 118 may extend inwardly over portion 136 opposite gripping channel 122, covering a relatively small portion of container aperture 112, if at all, preserving a wide secondary aperture 134 that will easily accommodate a user's inserted fingers and/or hand so as to grab a lead wipe. As shown, the portion 138 of landing member 118 opposite portion 136 (i.e., adjacent gripping channel 122 and fingers 132) may extend to a greater extent over container aperture 112, towards axis A, but still preserve a sufficiently large space so that a user's hands and/or fingers may be easily inserted into secondary aperture 134 without undue scraping and/or interference from portions 136 and 138 of landing member 118. For example, portion 138 of landing member 118 may cover less than 50%, less than 40%, or less than about 30% of circle $C_2$. For example, fingers 132 may extend no more than about 75%, no more than about 65%, no more than about 60%, or no more than about 50% of the distance from the edge of circle $C_2$ towards longitudinal axis A. This preserves a majority of the area of circle $C_2$ as the secondary aperture 134, allowing a user to insert fingers or a hand therein so as to retrieve a lead wipe, without fear of scraping the user's fingers or hand on the edges of secondary aperture 134.

Figure 3A:
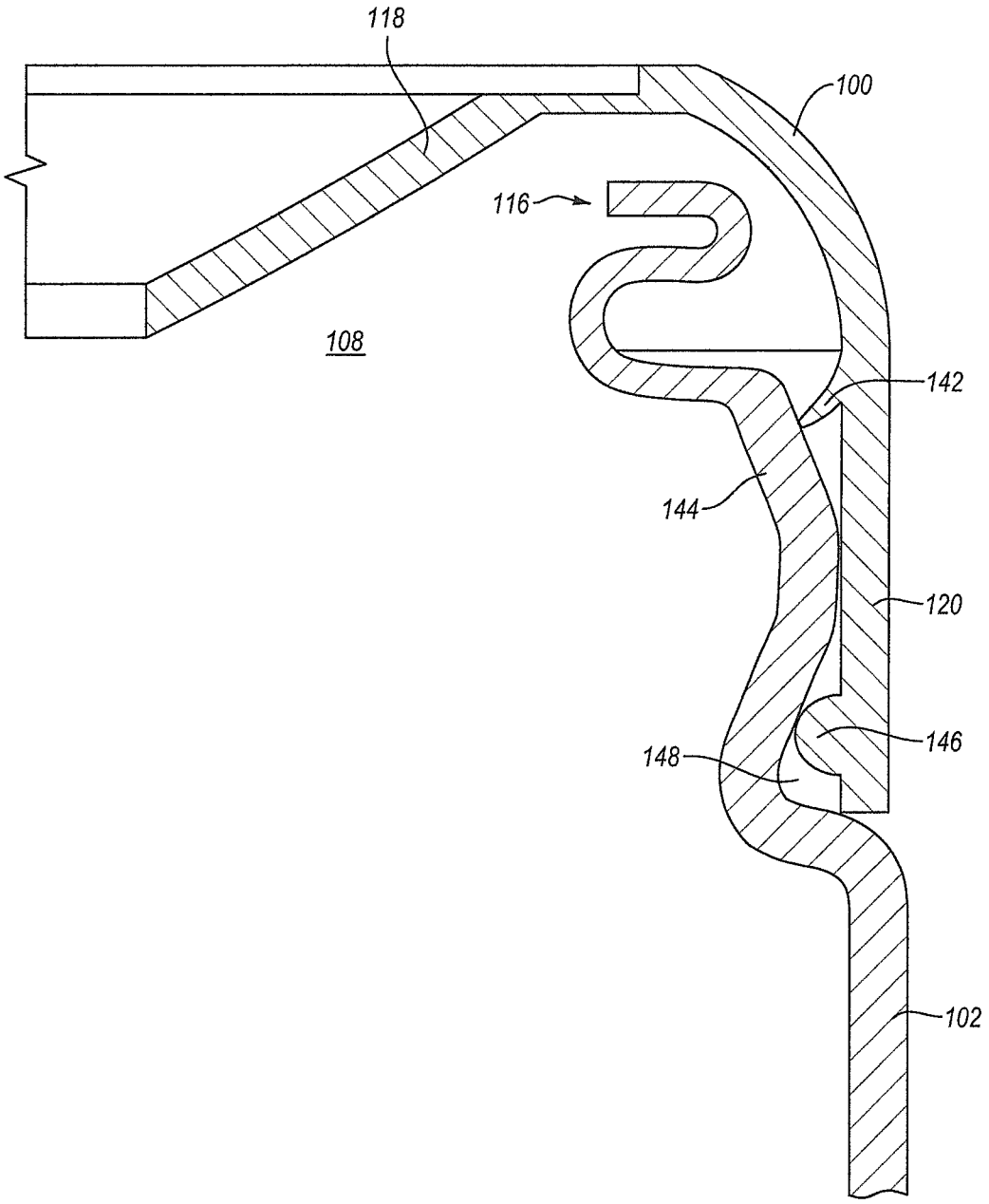
FIG. 3A is a cross-sectional view through the removable lid and container body of FIG. 3, illustrating an exemplary crab claw sealing member.

FIG. 3A shows a cross-sectional view along upper rim 116 of container body 102, as container body 102 engages with removable lid 100. In an embodiment, removable lid 100 may include a crab claw sealing member 142 which bends as it contacts side rim 144 of container body 102 as lid 100 is secured to container body 102. Such a crab claw sealing member aids in ensuring that internal region 108 is properly sealed so as to prevent the donut of wipes disposed in internal region 108 from prematurely drying out. In the illustrated embodiment, crab claw sealing member 142 may extend inwardly, towards the middle of container 104 from vertical sidewall 120 of removable lid 100. Crab claw sealing member 142 may extend from sidewall 120 at a downward angle of less than 90°, for example, from about 30° to about 70°, or from about 40° to about 60°. Such an angle orients crab claw sealing member 142 relative to side rim 144 so that crab claw sealing member 142 is deflected on contact with side rim 144, providing a seal therebetween.

Removable lid 100 may couple over top rim 116 of container body 102 by any suitable mechanism. As shown in FIG. 3A, removable lid 100 may include an annular ring 146 configured to be received within a corresponding annular groove 148 of container body 102. Such a mechanism may allow a user to simply press removable lid 100 over top 116 of container body 102. When ring 146 clicks into place in groove 148, the lid and container body are retained together. Removal of lid 100 may be achieved by simply pulling lid 100 off. In other embodiments, alternative coupling mechanisms (e.g., threads, mating grooves, etc.) may be provided.

Figure 4:
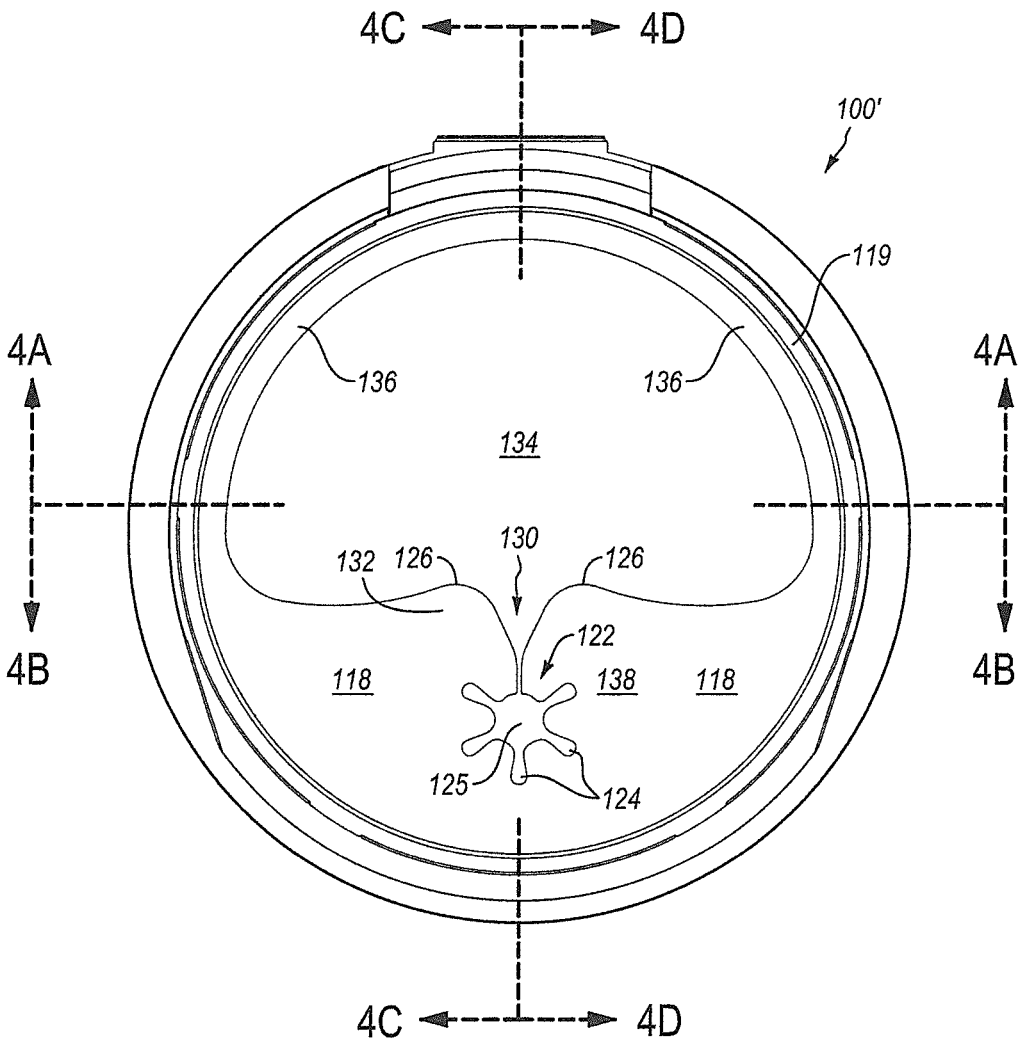
FIG. 4 is a top plan view of another removable lid.
Figure 4A:
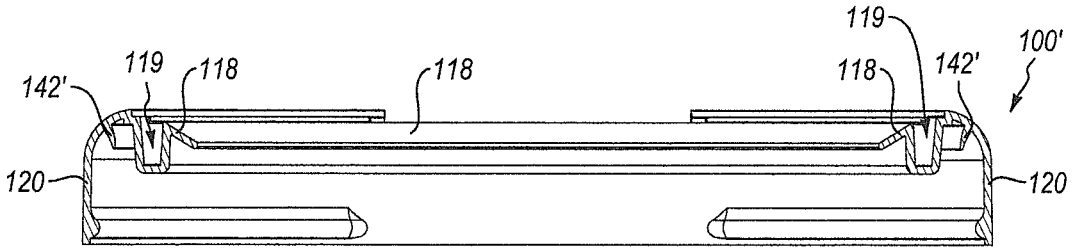
FIGS. 4A-4C show various cross-sectional views through the removable lid of FIG. 4.
Figure 4B:
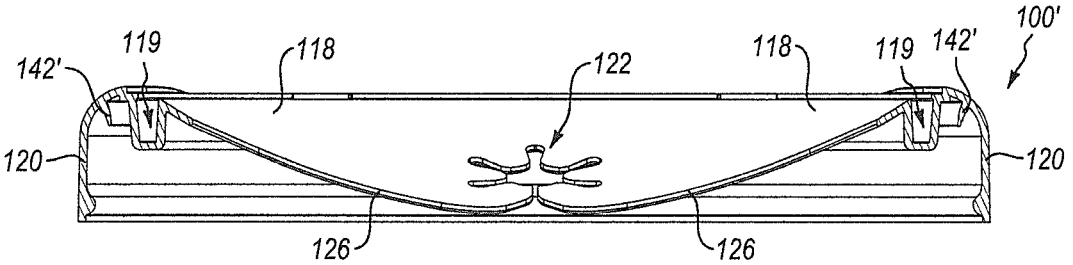
Figure 4C:
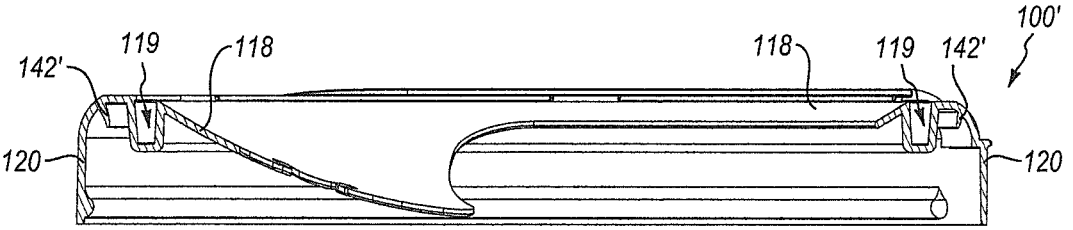
Figure 4D:
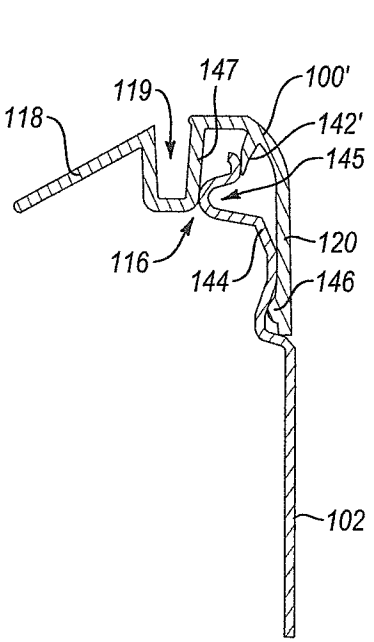
FIG. 4D shows a cross-sectional view through a removable lid and container, illustrating a somewhat differently configured sealing arrangement as compared to FIG. 3A.
Figure 4D:
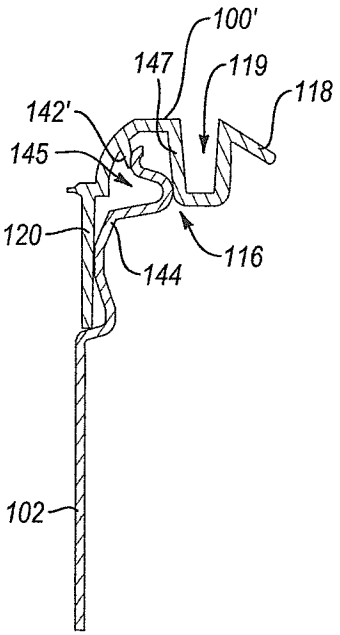
Figure 4E:
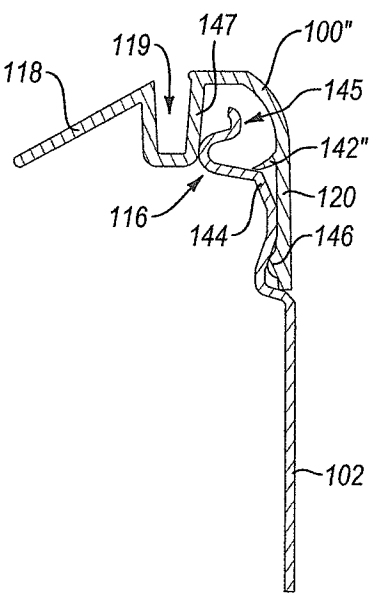
FIG. 4E shows another cross-sectional view through a removable lid and container, illustrating another alternative sealing arrangement.
Figure 4E:
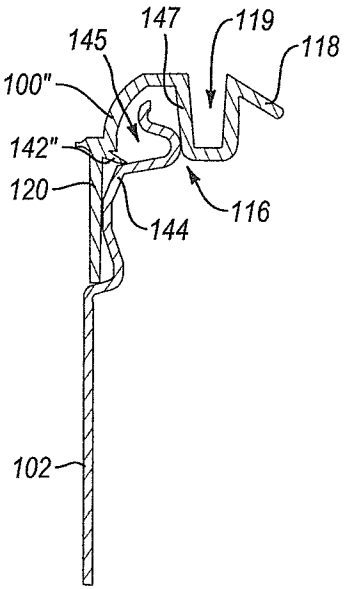

FIGS. 4-4E illustrate somewhat differently configured removable lids 100. For example, FIGS. 4-4D illustrate an embodiment similar to that of FIGS. 1-3A, but in which the sealing arrangement by which the removable lid provides a plug or seal to seal the container body are somewhat different. For example, lid 100' shown in FIG. 4 and the cross-sections shown in FIGS. 4A-4C are similar to lid 100 shown in FIGS. 2B and 2C-2E, respectively. Principal differences include a differently configured entrance 130, providing direct access into aperture 125, rather than the zig-zag threading portion, the inclusion of an annular groove 119 at the periphery of landing member 118, and a somewhat differently configured sealing mechanism including crab claw 142'. As perhaps best seen in FIG. 4D, crab claw 142' may press and seal against the uppermost curve in the S-shaped curved top portion 145 of container body 102. In addition, S-shaped curved portion 145 at top 116 of container body 102 may be sandwiched between crab claw 142' and the outer wall 147 defining groove 119 (FIG. 4D). Sealing contact by both crab claw 142' and the outer wall 147 provides an excellent seal for the interior of container body 102, within which the wipes are stored, preventing the wipes from drying out. In such an embodiment, crab claw 142' may be referred to as a top claw, as it is disposed at or near the top of removable lid 100', and may seal against the top or last curve at top 116 of container body 102.

FIG. 4E shows a similar embodiment 100", but which may be referred to as including a side claw, as the crab claw 142" seals against the top portion of side rim 144, similar to the embodiment seen in FIG. 3A. As in FIG. 4D, sealing contact may be provided between the S-curve portion 145 at the top 116 of container body 102 and outer wall 147 of groove 119, again providing two points of contact for improved sealing.

Although FIGS. 1-5 illustrate a gripping channel 122 including a flower shaped portion with petals 124, it will be appreciated that variously other shaped gripping channels may be employed. FIGS. 6A-6M illustrate several various alternative gripping channels 122. It will readily be apparent to one of skill in the art that gripping channels having shapes other than those shown herein may also be employed.

FIGS. 7-13 show an ornamental design for a wipes dispenser. In these Figures, the broken lines shown are directed to environmental structure and are for illustrative purposes only. The broken lines form no part of the claimed design.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A wipes dispenser comprising:

(a) a container comprising: a container body and a removable lid forming an interior region containing a plurality of wipes that are interconnected such that pulling on a lead end of a lead wipe of said plurality of wipes causes a following wipe of said plurality of wipes to also be pulled and follow said lead wipe;

(b) a container aperture defined through an exterior wall of said container;

(c) a concavely curved, rigid landing member which is part of said lid, the rigid landing member covering a portion of said container aperture by curving downwardly from a top rim of said container body and continuing said curvature toward a middle of the interior region of said container ending at an outer edge adjacent to the middle of the interior region of said container defined by a longitudinal axis A;

(d) a gripping channel having a radially extending threading portion in said landing member communicating with the interior of the container through said container aperture, wherein said gripping channel and an entrance to the threading portion are located on a same lateral axis running from the gripping channel through longitudinal axis A to a connection point connecting a cover to the removeable lid, and wherein said plurality of wipes are removed from said container by being pulled through said gripping channel, said gripping channel separating a lead wipe from a following wipe as said lead wipe is pulled through said gripping channel; and (e) a secondary aperture in said landing member wherein the secondary aperture is bounded by a radius corresponding to a circle $C_2$ and the landing member covers less than 50% of said circle $C_2$.

2. The wipes dispenser of claim 1, wherein said plurality of wipes are in the shape of a donut.

3. The wipes dispenser of claim 1, wherein said gripping channel is off-set from center point of said container.

4. The wipes dispenser of claim 1, wherein said gripping channel has a shape comprising a funnel shape portion that is wider at an entrance portion of the gripping channel at an outer edge of the landing member and narrows towards an opposite end of the gripping channel.

5. The wipes dispenser of claim 1, wherein the threading portion maintains a substantially uniform width between outer edges of the landing member extending from the container aperture to the gripping channel.

6. The wipes dispenser of claim 1, wherein the secondary aperture is bounded by a radius corresponding to a circle $C_2$ and the landing member covers less than 40% of said circle $C_2$.

7. The wipes dispenser of claim 1, wherein the secondary aperture is bounded by a radius corresponding to a circle $C_2$ and the landing member covers less than 30% of said circle $C_2$.

8. The wipes dispenser of claim 1, wherein said landing member comprises one or more fingers.

9. The wipes dispenser of claim 8, wherein the entire landing member is concavely curved.

10. A wipes dispenser comprising:

(a) a container comprising: a container body and a removable lid forming an interior region containing a plurality of wipes that are interconnected such that pulling on a lead end of a lead wipe of said plurality of wipes causes a following wipe of said plurality of wipes to also be pulled and follow said lead wipe;

(b) a container aperture, defined through an exterior wall of said container, said container aperture having a diameter approximately equal to the diameter of the removable lid and corresponding to a circle $C_1$; and (c) a rigid landing member is part of said lid covers a portion of said container aperture by extending downwardly from a top rim of said container body inwardly toward the middle of the interior region of said container creating a concave portion of the landing member;

(d) a gripping channel comprising a plurality of fingers which are the furthest extension of landing member towards longitudinal axis A in the middle of the interior region, said gripping channel having a radially extending threading portion in said landing member communicating with the interior of the container through said container aperture, the threading portion maintaining a substantially uniform width between outer edges of the landing member extending from the container aperture to the gripping channel, wherein said gripping channel is off-set from center point of said container aperture, wherein said gripping channel and an entrance to the threading portion are located on a same lateral axis running from the gripping channel through longitudinal axis A to a connection point connecting a cover to the removeable lid, and wherein said plurality of wipes are removed from said container by being pulled through said gripping channel, said gripping channel separating a lead wipe from a following wipe as said lead wipe is pulled through said gripping channel;

(e) a large, secondary aperture in said landing member, wherein the secondary aperture is bounded by a radius corresponding to a circle $C_2$ and the landing member covers less than 50% of said circle $C_2$.

11. The wipes dispenser of claim 10, wherein said plurality of wipes are in the shape of a donut.

12. The wipes dispenser of claim 10, wherein said gripping channel is off-set from center point of said container.

13. The wipes dispenser of claim 10, wherein said gripping channel has a shape comprising a funnel shape portion that is wider at an entrance portion of the gripping channel at an outer edge of the landing member and narrows towards an opposite end of the gripping channel.

14. The wipes dispenser of claim 10, wherein said gripping channel is off-set from center point of said container aperture.

15. The wipes dispenser of claim 10, wherein the secondary aperture is bounded by a radius corresponding to a circle $C_2$ and the landing member covers less than 40% of said circle $C_2$.

16. The wipes dispenser of claim 10, wherein the entire landing member is concavely curved.

17. A wipes dispenser comprising:

(a) a container comprising: a container body and a removable lid forming an interior region containing a plurality of wipes that are interconnected such that pulling on a lead end of a lead wipe of said plurality of wipes causes a following wipe of said plurality of wipes to also be pulled and follow said lead wipe;

(b) a sealing member provided on said removable lid which bends as it contacts a side rim of said container body when the lid is secured to said container body; and (c) a container aperture defined through an exterior wall of said container, said container aperture having a diameter approximately equal to the diameter of the removable lid and corresponding to a circle $C_1$; and (d) a concave, rigid landing member which is part of said lid, covers a portion of said container aperture by extending from a top rim of said container body toward the middle of the interior region of said container;

(e) a gripping channel having a downwardly angled configuration in said landing member and communicating with the interior of the container through said container aperture, wherein said gripping channel has a radially extending threading portion in said landing member communicating with the interior region of the container through said container aperture, the threading portion maintaining a substantially uniform width between outer edges of the landing member extending from the container aperture to the gripping channel, wherein said gripping channel and an entrance to the threading portion exist on a same lateral axis running from the gripping channel through the middle of the interior region of said container to a connection point connecting a cover to the removeable lid, and wherein said plurality of wipes are removed from said container by being pulled through said gripping channel, said gripping channel separating a lead wipe from a following wipe as said lead wipe is pulled through said gripping channel; and (f) a large, secondary aperture in said landing member wherein the secondary aperture is bounded by a radius corresponding to a circle $C_2$ and the landing member covers less than 50% of said circle $C_2$.

18. The wipes dispenser of claim 17, wherein said plurality of wipes are in the shape of a donut.

19. The wipes dispenser of claim 17, wherein said gripping channel is off-set from center point of said container.

20. The wipes dispenser of claim 17, wherein said container body and said removable lid form a secondary seal point between the internal rim wall of the lid and the side rim of said container body.

21. The wipes dispenser of claim 17, wherein said threading portion has a zig-zag shape.

* * * * *